United States Patent [19]

Vandeveld

[11] Patent Number: 4,919,421

[45] Date of Patent: Apr. 24, 1990

[54] TENNIS BALL DIVERTER

[76] Inventor: Paul A. Vandeveld, 1930 N. Prospect Ave., Milwaukee, Wis. 53202

[21] Appl. No.: 312,933

[22] Filed: Feb. 21, 1989

[51] Int. Cl.[5] ..... A63B 61/00; A63B 69/38

[52] U.S. Cl. ..... 273/29 B; 273/26 D; 273/181 F; 273/30

[58] Field of Search ..... 229/115, 124; 273/26 A, 273/182 R, 55 R, 348, 394, 29 R, 29 A, 29 B, 31, 181 F, 26 D; 272/3

[56] References Cited

U.S. PATENT DOCUMENTS

| | | | |
|---|---|---|---|
| 1,996,778 | 4/1935 | Wellman | 229/115 |
| 2,615,715 | 10/1952 | Moore . | |
| 3,918,711 | 11/1975 | Zak | 273/26 A |
| 4,203,413 | 5/1980 | Hodges . | |
| 4,643,423 | 2/1987 | Wright . | |

*Primary Examiner*—Edward M. Coven
*Assistant Examiner*—William M. Pierce
*Attorney, Agent, or Firm*—Andrus, Sceales, Starke & Sawall

[57] ABSTRACT

A folding ball diverter for use with a tennis net. The diverter is composed of a folded sheet of material that includes a pair of panels which are positioned at an angle to each other. A first of the panels is inclined upwardly and includes a low end that rests on the playing surface adjacent the net. A plurality of punched out tabs are connected to one of the panels and engage apertures in the other panel to hold the panels in the angular configuration. A tennis ball striking the net will fall downwardly into engagement with the first panel and be retained against the lower end of the net to prevent the ball from rolling back onto the court. The lower edge of the first panel can be provided with a plurality of connecting lugs which are connected to lugs on a second diverter located on the opposite side of the net.

17 Claims, 2 Drawing Sheets

FIG. 1
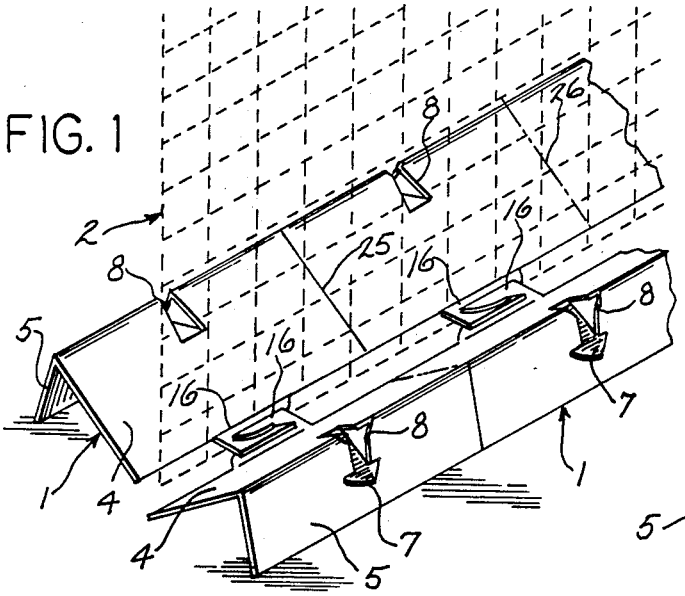
FIG. 2
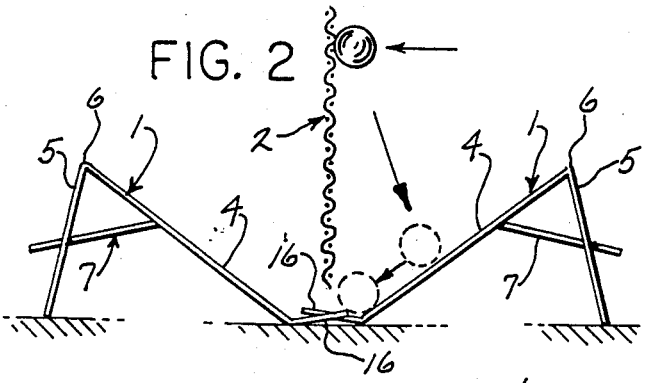
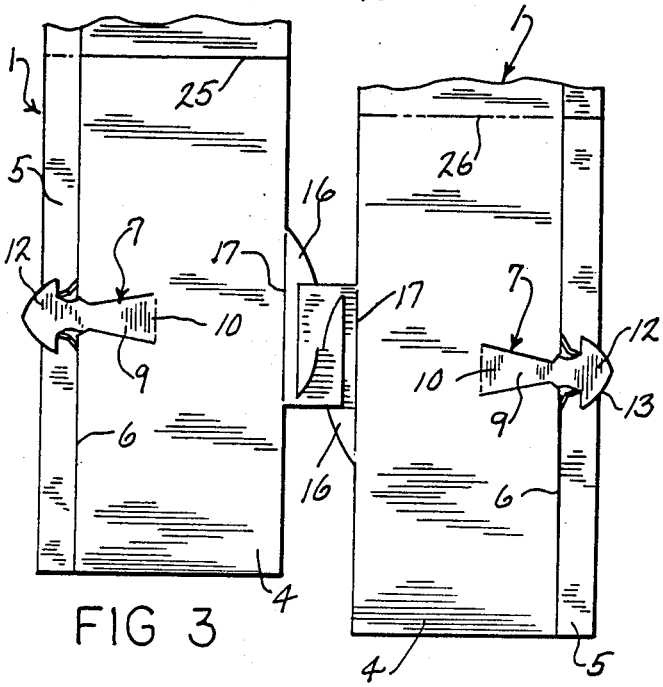
FIG 3
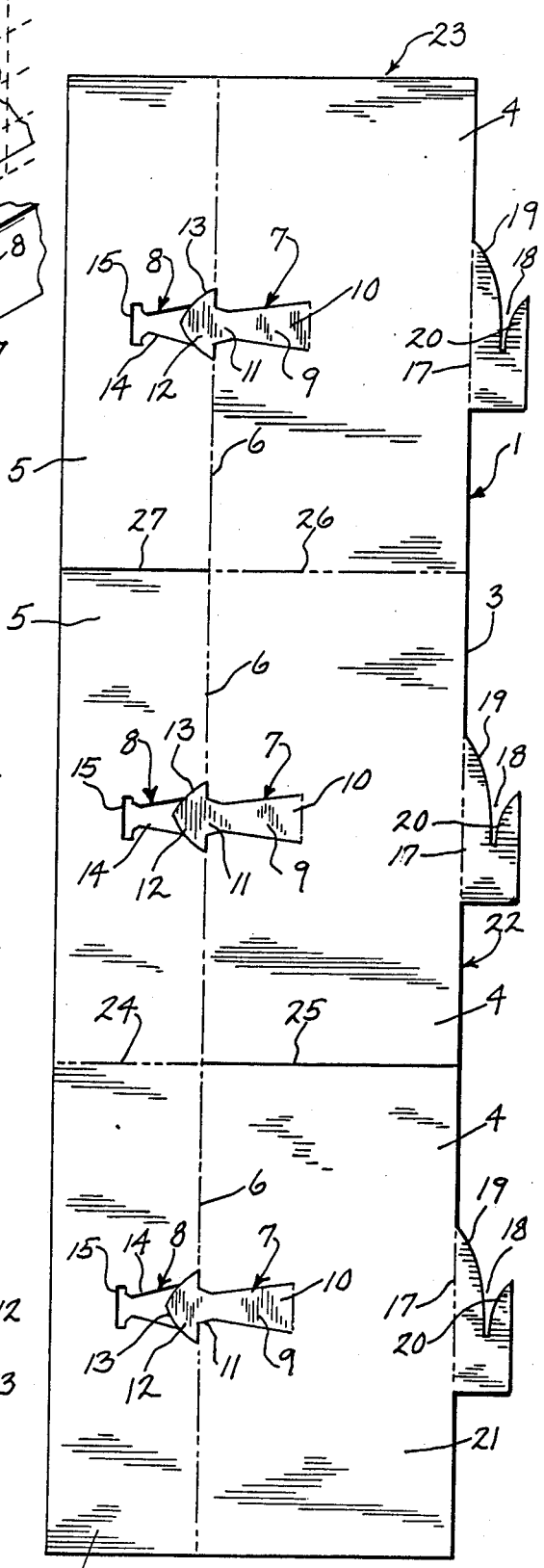
FIG. 4

TENNIS BALL DIVERTER

BACKGROUND OF THE INVENTION

A problem encountered in either competitive or instructional tennis is the tendency of the balls, after striking the net, to settle on the playing surface and thus constitute a hazard or annoyance to the players. For example, in instructional drilling, a large number of balls are used and as a serve, volley or ground stroke strikes the net, the ball will bounce back toward the player or will settle on the court, presenting a hazard to the player and causing the player to interrupt the instruction to deflect the ball out of the playing surface, or to retrieve the ball and place it in his pocket.

In competitive singles, a fault serve which strikes the net will tend to roll outwardly across the court, forcing the server to discontinue his service, go forward and remove the grounded ball from the court. Thus, the service ball striking the net and rolling across the floor provides a distraction as well as a potential hazard to the server.

In competitive doubles, a netted serve is normally retrieved by the server's partner who is at the net. This again causes a distraction to play and a potential hazard if the grounded ball is not retrieved by the server's partner or by the server.

U.S. Pat. No. 2,615,715 discloses a tennis net construction having a pocket located adjacent the lower end of each side of the net. When a tennis ball being propelled with a substantial force strikes the net, the net will belly out and the ball will fall downwardly into the pocket where it is retained. However, the device of U.S. Pat. No. 2,615,715 requires a special net construction and is not completely dependable in that a ball striking the net with a minimum force will not belly the net out sufficiently to enable the ball to be received within the pocket.

Therefore, there has been a need for an inexpensive, portable device to be associated with a tennis net for diverting and collecting balls striking the net.

SUMMARY OF THE INVENTION

The invention is directed to an inexpensive, folding, ball diverter for use with a tennis net. The diverter is formed of a folded sheet of material, such as cardboard, and includes a pair of panels which, in the operative mode, are positioned in an inverted-V configuration. A first of the panels has a low end which rests on the ground adjacent the lower end of the net while the upper edge of the first panel is connected to the upper edge of the second panel along a longitudinal fold line.

One of the panels is provided with a series of punched out tabs which are received with apertures in the other panel to hold the panels in the angular configuration.

A tennis ball striking the net will fall downwardly into engagement with the inclined first panel which acts to deflect the ball back toward the net where it is retained between the net and the panel, thus preventing the ball from rolling or bouncing back onto the court where it could constitute a hazard as well as annoyance to play.

It is contemplated that the lower edge of the first panel can be provided with a series of locking lugs which engage locking lugs on a second diverter located on the opposite side of the net. The engagement of the two diverters located on opposite sides of the net provides greater stability and prevents movement of the diverters under the impact of a tennis ball.

In a modified form of the invention the diverter is formed of three folding panels which, in the operative mode, are locked in a generally triangular configuration. A first panel of the diverter is inclined upwardly from the lower end of the net and the upper edge of the panel is formed with a plurality of spaced locking tabs which are received in recesses in the upper edge of a second panel. The upper edge of the second panel projects upwardly beyond the upper edge of the first panel to provide an extended flange or a lip which aids in deflecting the balls back toward the net for collection. The third panel of this diverter lies flush against the surface of the court.

For storage, the panels can be folded longitudinally and it is also comtemplated that the panels can be folded laterally to provide a compact folded package that can be readily stored or carried in a tennis bag.

As the diverter is preferably formed from inexpensive sheet material, such as cardboard, it is lightweight and inexpensive. Since as it is not permanently attached to either the net or the court, it can be used for instructional tennis and/or competitive tennis and yet readily removed from the court for championship tennis.

Other objects and advantages will appear in the course of the following description.

The drawings illustrate the best mode presently contemplated of carrying out the invention.

DESCRIPTION OF THE DRAWINGS

In the drawings:

FIG. 1 is a perspective view of a pair of diverters as associated with a tennis net;

FIG. 2 is a side elevation of the diverters;

FIG. 3 is a fragmentary top plan view of the construction illustrated in FIG. 1;

FIG. 4 is a plan view of the unfolded sheet material used to construct the diverter;

DESCRIPTION OF THE ILLUSTRATED EMBODIMENT

Figure 5:
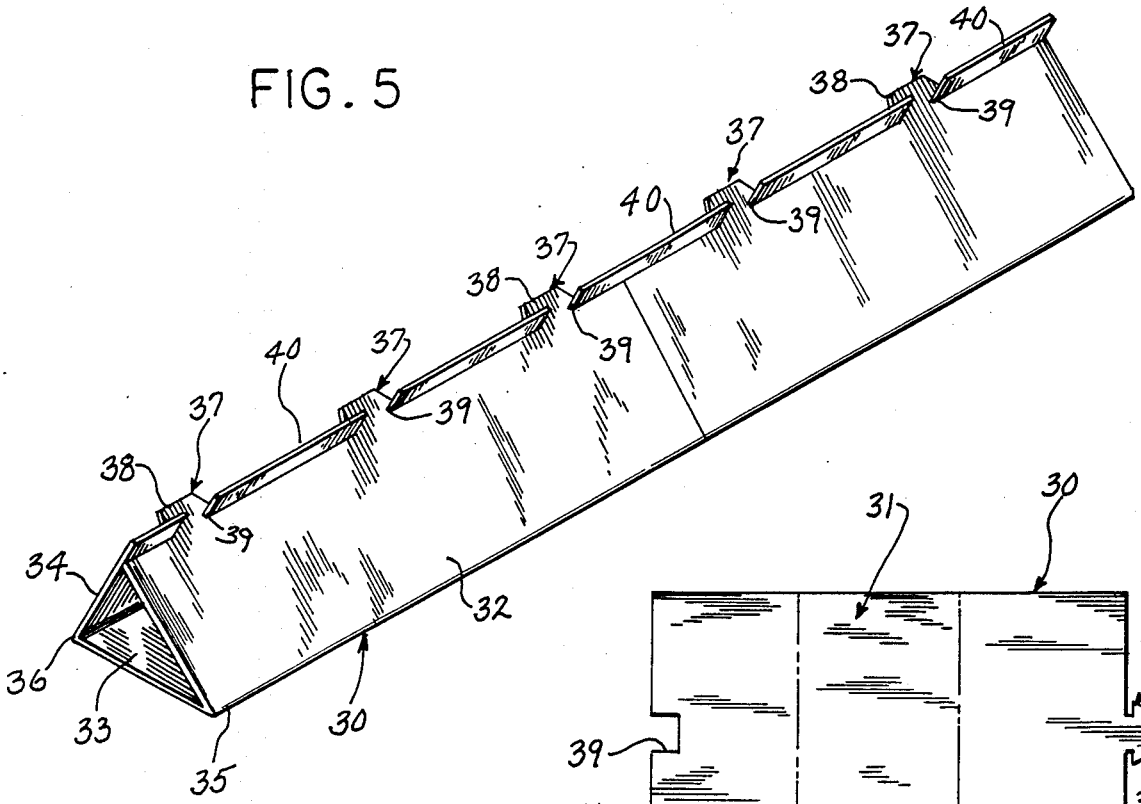
FIG. 5 is a perspective view of a modified form of the invention.

FIGS. 1–4 illustrate a pair of tennis ball diverters 1 that are associated with a tennis net 2. As illustrated, the diverters are located on opposite sides of the net and are supported on the court surface.

Each of the diverters 1 is constructed from a sheet 3 of material, such as cardboard, plastic, wood or the like, and the diverter is composed of a pair of panels 4 and 5 which are connected along a fold line or junction 6.

As best illustrated in FIG. 2, each panel 4 is inclined upwardly at an angle of about 30° to 40° with respect to the horizontal with the lower end of the panel 4 being located adjacent the lower edge of the net. Panel 5 which is connected to panel 4 along fold line 6 can extend vertically or at an angle of about 10° to 20° with respect to the vertical.

Panels 4 and 5 of each diverter are maintained in the angular configuration by engagement of a series of locking tabs 7 which are connected to panel 4 and are engaged with openings 8 formed in panel 5.

As best shown in FIG. 4, each locking tab includes a elongated stem 9 the base 10 of which is connected to the panel 4. Stem 9 tapers down into a narrowed neck 11 which terminates in an enlarged head 12 having an outer curved edge 13.

Each of the openings 8 is provided with a tapered section 14 which terminates in a notch 15 of greater horizontal width, as best shown in FIG. 4.

To engage tab 7 with openings 8, tapered stem 9 is moved downwardly along converging section 14 of the opening 8 to bring the neck 11 into engagement with the notch 15. The enlarged head 12 will then engage the outer surface of panel 5 to lock the panels 4 and 5 in the angular configuration. To release the tabs, panels 4 and 5 can be manually drawn together to move the heads 12 of the tabs out of engagement with the outer surface of panel 5 and the stems 9 of the tabs can then be moved along the tapered sections 14 to release the engagement. This is accomplished by aligning the narrowed neck 11 of stem 9 with the narrow portion of slot 14, the width of each being approximately equal.

The two diverters 1 are locked together by interlocking tabs or lugs 16. Each tab 16 is secured to the lower edge of panel 4 along a fold line 17 and each tab 16 is formed with a longitudinal slit 18 which is bordered by a pair of curved edges 19 and 20. The slits 18 of the tabs on the diverters 1 are brought into interlocking relation to lock the diverters together at a location beneath net 2, as shown in FIG. 1.

Normally tabs 16 are flush with the panels 4 which facilitates interlocking of the tabs as well as extending the height of the panels 4. However, in some instances the tabs 16 may be bent at a slight angle with respect to the panels 4, along fold lines 17.

Each diverter 1 is composed of a series of sections which extend along the length of the diverter. As shown in FIGS. 1–4. each diverter 1 is composed of three sections 21, 22 and 23. Section 21 is separated from section 22 by fold line 24 which extends laterally of section 4 and an aligned slit 25 formed in the panel 4. Similarly section 22 is divided from section 23 by a fold line 26 formed in panel 4 and a slit 27 formed in panel 5. Diverters 1 can be formed with any desired length and can be composed of any number of folding sections.

With this construction, the flat sheet, as shown in FIG. 4, is initially folded along the longitudinal fold line 6 and the sections 21 and 23 are then folded over the central section 22 along the fold lines 24 and 26. The fold lines 24 and 26 are located along the inside of the respective fold. With this arrangement, the entire diverter can be folded into a small package of a size that will fit into a conventional tennis bag.

When a tennis ball strikes the net it will be deflected downwardly into engagement with panel 4, as seen in FIG. 1, and panel 4 will deflect the ball toward the net where it will be collected in the gap between the net and the panel, thus preventing the ball from rolling or bouncing back toward the player or settling on the court, where it could provide a hazard as well as a distraction to the players.

While the drawings illustrate a pair of diverters 1 located on either side of the net, it is contemplated that one or more diverters can be used on each side of the net to provide coverage along the entire length of the net, if desired.

Figure 6:
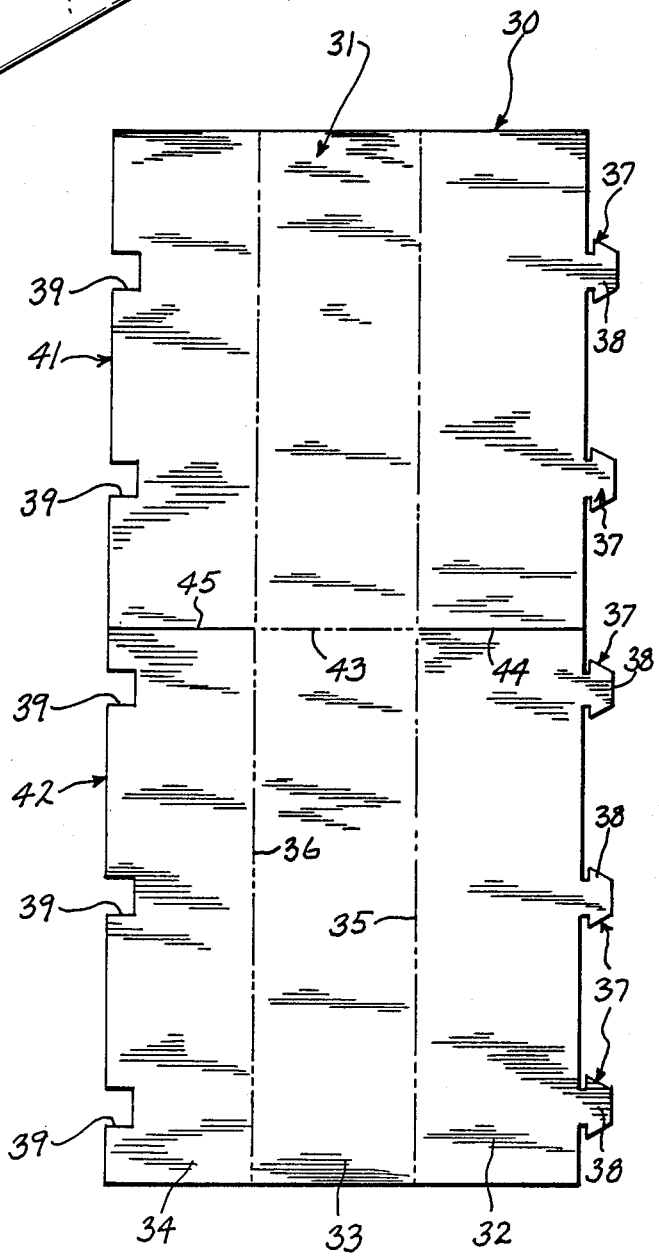
FIG. 6 is a plan view of the sheet material employed to construct the diverter of FIG. 5.

FIGS. 5 and 6 illustrate a modified form of the invention in which a diverter 30, similar in function to diverter 1, is formed of a sheet 31 of material such as cardboard, plastic, sheet metal or the like. Diverter 30 includes three panels 32, 33 and 34. Panel 32 is inclined to the horizontal and includes a lower edge that is located adjacent the lower end of the net. The lower edge of panel 32 is connected by a fold or bend 35 to panel 33 which rests on the court, and the opposite side edge of panel 33 is connected through a fold or bend 36 to panel 34. As shown in FIG. 5 the panels 33–34 are arranged in generally triangular configuration with panel 32 extending at an angle of about 30° to 40° to the horizontal.

Panels 32–34 are maintained in the triangular configuration, as shown in FIG. 5, by a locking tab arrangement. In this regard, a plurality of tabs 37 are spaced along the upper edge of panel 32 and each tab 37 is provided with an enlarged head 38 which is engaged within a recess 39 formed in the upper edge of panel 34. With this construction, the upper extremity of panel 34 projects beyond the panel 32 to provide an upstanding flange or lip 40 that extends the height of the diverter and aids in deflecting the balls back toward the net 2.

As in the case of diverter 1, diverter 30 is composed of a pair of sections 41 and 42. The sections 41 and 42 are separated by a fold 43 that extends transversely across panel 33 and is aligned with slits 44 and 45 formed in panels 32 and 34 respectively.

To fold the diverter 30, panels 32 and 34 are folded inwardly along lines 35 and 36, respectively, against the upper surface of panel 33 and the two sections 41 and 42 of panel 33 are then brought together in back-to-back relation by folding along the transverse fold line 43. This provides a compact folded package that can be readily stored or transported.

The diverter of FIGS. 5 and 6 being composed of three panels, has greater stability and is less likely to be moved through impact of a tennis ball. However, the two panel diverter, as shown in FIGS. 1–4, is lighter in weight and can be folded into a more compact package.

While the above description has shown the diverter mounted in a manner in which the balls are deflected back toward the net for collection, it is contemplated that the diverter can be reversed so that the panel 4 or 32 faces outwardly away from the net in which case the balls, after striking the net, will fall downwardly onto the panel 4, 32 and be deflected back toward the service line. The diverter could be used in this fashion for drilling purposes, as for example, when practicing serving. Various modes of carrying out the invention are contemplated as being within the scope of the following claims particularly pointing out and distinctly claiming the subject matter which is regarded as the invention.

I claim:

1. In combination, a tennis court including a court surface, a net extending across said court surface, and a tennis ball diverter comprising a foldable sheet of rigid material including an inclined first panel and a second panel, said panels being disposed at an angle to each other when the diverter is in an operative mode, each of said panels having a lower end and an upper end, said lower ends engaged with the court surface adjacent the lower end of the net when said diverter is in said operative mode and the upper end of the first panel being connected to the upper end of said second panel, and releasable locking means for connecting said panels together in said operative mode and including a tab on one of said panels and an opening to receive the tab disposed in the other of said panels.

2. The combination of claim 1, wherein said locking means comprises a tab pivotably connected to said first panel, said opening being located in said second panel.

3. The combination of claim 2, wherein each tab includes a stem portion connected to said first panel, a neck having a lesser width than said stem and an enlarged head.

4. The combination of claim 3, wherein said opening includes a tapered recess terminating in an enlarged notch, said head being insertable through said notch and into an engagement with the outer surface of said second panel.

5. The combination of claim 1, and including connecting means on the lower end of the first panel and engageable with connecting means on the lower end of a second diverter to provide a releasable connection between said diverters.

6. The combination of claim 5, wherein said connecting means comprises a tab having a longitudinal slot.

7. The combination of claim 6, wherein each tab has a pair of curved edges bordering the slot.

8. The diverter of claim 1, and including a third panel connected to the lower end of one of said first and second panels, said first, second and third panels disposed in generally triangular relationship when said diverter is in the operative mode.

9. The diverter of claim 8, and including a plurality of tabs disposed on the upper edge of said first panel and a plurality of recesses formed in the upper edge of said second panel and disposed to be engaged by said tabs to maintain said panels in said triangular relationship.

10. The diverter of claim 9, wherein each tab is provided with an enlarged head disposed to engage the outer surface of said second panel when said tabs are engaged with said recesses.

11. The diverter of claim 8, wherein said third panel is horizontal and rests on the court surface.

12. A tennis ball diverter to be used in combination with a tennis net, comprising a sheet of material and including a first panel and a second panel connected to the first panel along a longitudinal fold line, the first of said panels being disposed at an acute angle to the horizontal when said panels are in an operative mode, releasable locking means for locking the panels in the operative mode, said sheet in the flat unfolded condition including a second fold line extending laterally from a side edge of the first panel to said longitudinal fold, said second panel having a slit extending from a side edge of the second panel to said longitudinal fold and aligned with said second fold, and a third fold extending laterally from the side edge of said second panel to said longitudinal fold, said first panel having a slit extending from the side edge of the first panel to the longitudinal fold and aligned with said third fold, said second and third folds and said aligned slits dividing said diverter into three sections spaced along the length of said diverter.

13. The diverter of claim 12, wherein said locking means comprises a plurality of pivotably tabs connected to one panel and a plurality of apertures in the other panel to receive said tabs.

14. A tennis ball diverter to be used in combination with a tennis net, comprising a sheet of foldable material, said sheet when in a folded operative mode including a first panel disposed at an acute angle to the horizontal, a second panel connected to the lower end of said first panel along a first longitudinal fold line and disposed generally horizontally and a third panel connected to the opposite end of said second panel along a second longitudinal fold line, said sheet in the flat unfolded state including a third fold line extending transversely of said second panel between said first and second longitudinal fold lines, said first and third panels having transverse slits aligned with said third fold line, interlocking tab means formed on the upper edges of said first and third panels to connect said panels in a generally triangular relationship, the lower end of said first panel being disposed adjacent the lower end of said net whereby tennis balls striking the net will fall downwardly into contact with said first panel for collection in the space between said first panel and the net.

15. In combination, a tennis court including a court surface, a net extending across said court surface, and a tennis ball diverter comprising a foldable sheet of material including an inclined first panel and a second panel connected to said first panel along a first longitudinal fold line, said panels being disposed at an angle to each other when the diverter is in an operative mode, each of said panels having a lower edge and an upper edge, said lower edges being disposed in contact with said court surface adjacent the lower end of the net and the upper edge of the first panel being connected to the upper edge of the second panel, releasable locking means for connecting the panels together in the operative mode, said sheet in the flat unfolded condition including a second fold line extending transversely from said first edge of said first panel to said first longitudinal fold line, said second panel having a slit extending transversely from the first edge of the second panel to said first longitudinally fold line and longitudinally aligned with said second fold line.

16. The diverter of claim 15, wherein said locking means is spaced centrally of each of said sections.

17. A tennis ball diverter to be used in combination with a tennis net, comprising a sheet of material and including a first panel and a second panel connected to the first panel along a longitudinal fold line, a first of said panels being disposed at an acute angle to the horizontal when said panels are in an operative mode, releasable locking means for locking the panels in the operative mode, said sheet in the flat unfolded condition including a second fold line extending laterally from a side edge of the first panel to said longitudinal fold line, said second panel having a slit extending from a side edge of the second panel to said longitudinal fold line and aligned with said second fold line, and connecting means on the lower end of the first panel and engageable with connecting means on the lower end of a second diverter to provide a releasable connection between a pair of diverters.

* * * * *

UNITED STATES PATENT AND TRADEMARK OFFICE

CERTIFICATE OF CORRECTION

PATENT NO. : 4,919,421

DATED : April 24, 1990

INVENTOR(S) : PAUL A. VANDEVELD

It is certified that error appears in the above-identified patent and that said Letters Patent is hereby corrected as shown below:

Col. 5, Line 54, After "of" cancel "pivotably tabs" and substitute therefor ---tabs pivotably---

Signed and Sealed this

Sixth Day of October, 1992

*Attest:*

DOUGLAS B. COMER

*Attesting Officer*

*Acting Commissioner of Patents and Trademarks*